US005197827A

United States Patent [19]

Lee

[11] Patent Number: 5,197,827

[45] Date of Patent: Mar. 30, 1993

[54] METHOD FOR LOWERING A BASEMENT STRUCTURE

[76] Inventor: Yuan-Ho Lee, 7F-3, No. 8, Lane 390, Sec. 1, Chien-Kang Rd., Tainan, Taiwan

[21] Appl. No.: 830,662

[22] Filed: Feb. 4, 1992

[51] Int. Cl.[5] ..... E02D 29/00

[52] U.S. Cl. ..... 405/229; 405/133; 405/232

[58] Field of Search ..... 405/229, 230, 232, 239, 405/290, 196, 133, 233

[56] References Cited

U.S. PATENT DOCUMENTS

| | | | |
|---|---|---|---|
| 2,213,169 | 8/1940 | Ouchi | 405/229 |
| 4,338,047 | 7/1982 | David | 405/230 |
| 4,850,743 | 7/1989 | Hopper | 405/229 X |
| 4,854,782 | 8/1989 | May | 405/230 |
| 4,938,634 | 7/1990 | Lee | 405/229 |

*Primary Examiner*—David H. Corbin
*Attorney, Agent, or Firm*—Knobbe, Martens, Olson & Bear

[57] ABSTRACT

A method for lowering a basement structure includes forming several upright pile holes in the ground, providing each of the pile holes with a pile, providing several vertical guide holes and an excavation passage which are formed through the basement structure in such a manner that the guide holes are aligned with the pile holes, equipping each of the guide holes with an impelling device which is coupled with one of the piles, excavating soil below the basement structure, and activating the impelling devices to lower the basement structure into the ground in such a manner that the piles extend through the guide holes. Several vertical steel rods are embedded in each of the piles. Each of the impelling devices includes an upright cylinder body fixed on the top end of the basement structure, a piston rod extending through the cylinder body, and a piston carried on the piston rod. An internally threaded engaging member is engaged with the externally threaded lower portion of the piston rod. Several coupling bar units interconnect securely the engaging member and the upper ends of the steel rods. Each of the coupling bar units includes several bar sections arranged in a line and several collars detachably interconnecting the bar sections. A rotary lever unit is secured to the piston rod.

14 Claims, 8 Drawing Sheets

METHOD FOR LOWERING A BASEMENT STRUCTURE

BACKGROUND OF THE INVENTION

1. Field of the Invention

This invention relates to a method for constructing a basement in the ground, more particularly to a method for lowering a prefabricated basement structure into the ground which can maintain the vertical descent of the basement structure during the lowering process.

2. Description of the Related Art

Because a prefabricated basement structure is lowered into the ground by the pull of gravity, it is very heavy, so if it is tilted during its lowering process, it is difficult to place the basement structure in a substantially vertical position when the basement structure reaches the predetermined position in the ground. In U.S. Pat. Nos. 4,938,634 and 5,004,375, the applicant disclosed two improved basement structure lowering methods which can keep the vertical descent of the basement structure. The applicant now tries another approach thereto.

SUMMARY OF THE INVENTION

It is therefore the main object of this invention to provide a method for lowering a prefabricated basement structure into the ground which can maintain the levelness of the basement structure while lowering the same.

According to this invention, a method for lowering a basement structure includes forming several upright pile holes in the ground, providing each of the pile holes with a pile, providing several vertical guide holes and an excavation passage which are formed through the basement structure in such a manner that the guide holes are aligned with the pile holes, equipping each of the guide holes with an impelling device which is coupled with one of the piles, excavating soil below the basement structure, and activating the impelling devices to lower the basement structure into the ground in such a manner that the piles extend through the guide holes. Several vertical steel rods are embedded in each of the piles. Each of the impelling device includes an upright cylinder body fixed on the top end of the basement structure, a piston rod extending through the cylinder body, and a piston carried on the piston rod. An internally threaded engaging member is engaged with the externally threaded lower portion of the piston rod. Several coupling bar units interconnect securely the engaging member and the upper ends of the steel rods. Each of the coupling bar units includes several bar sections arranged in a line and several collars detachably interconnecting the bar sections. A rotary lever unit is secured to the piston rod and can be rotated to move the piston rod vertically.

BRIEF DESCRIPTION OF THE DRAWINGS

Other features and advantages of this invention will become apparent in the following detailed description of a preferred embodiment of this invention, with reference to the accompanying drawings, of which.

DETAILED DESCRIPTION OF THE PREFERRED EMBODIMENT

Figure 1:
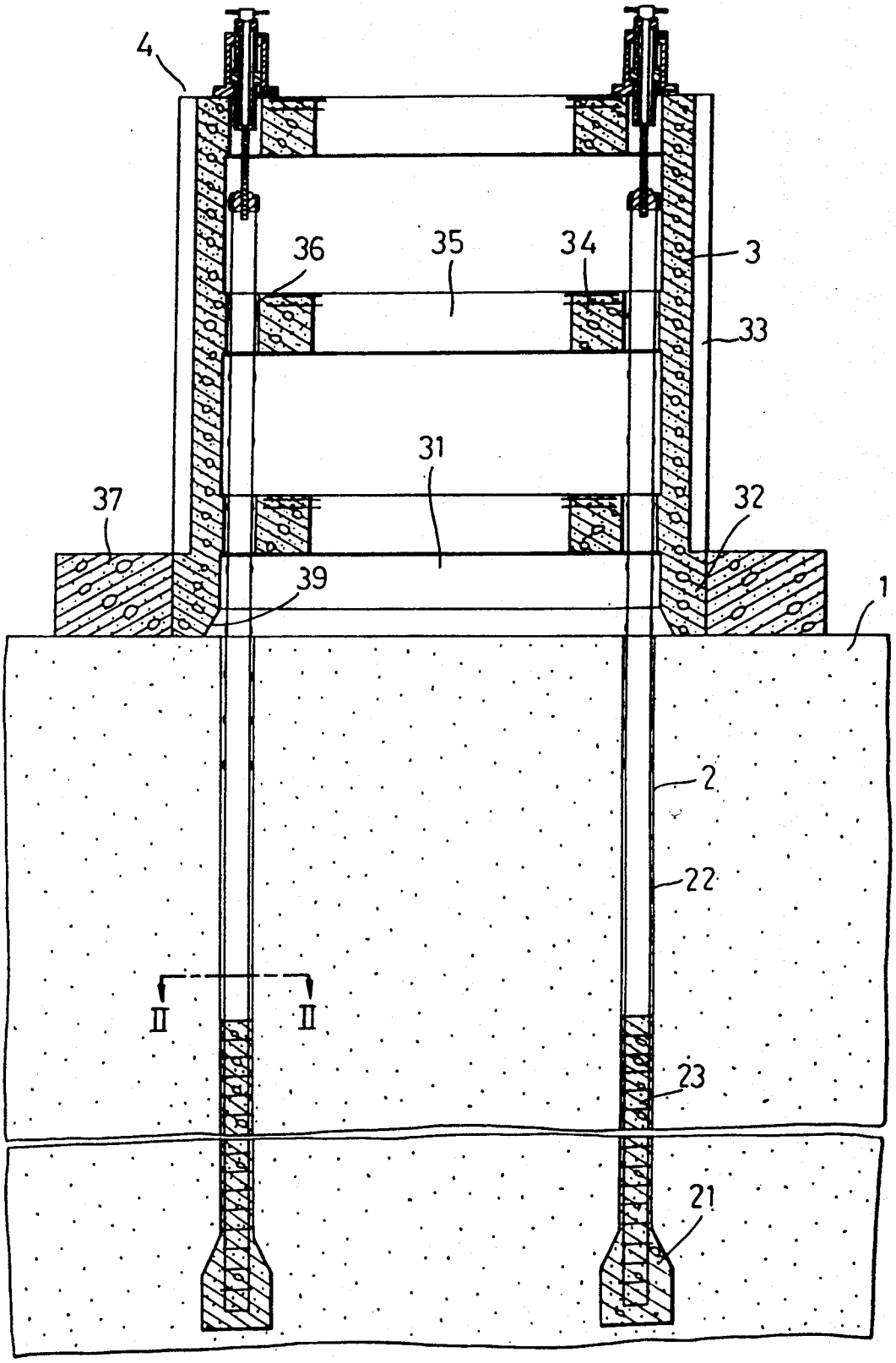
FIG. 1 illustrates a method for lowering a basement structure into the ground according to this invention.
Figure 2:
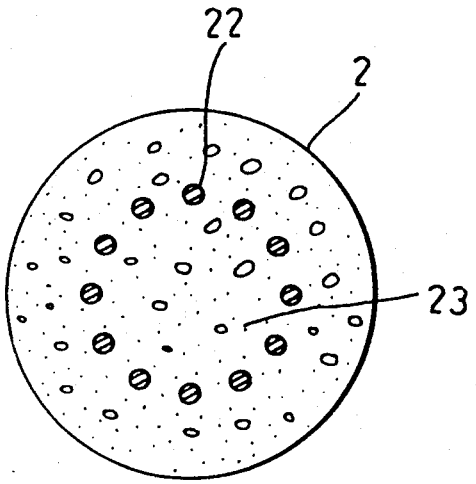
FIG. 2 is a sectional view taken along Line II—II in FIG. 1, showing the cross section of a pile used in the method of this invention.

Referring to FIG. 1, a method for lowering a prefabricated basement structure (3) into the ground (1) has a first step of drilling into the ground (1) to form several upright pile holes (2) in the region in which the basement is to be installed. A soil stabilizing agent is applied to the peripheral walls o f the pile holes (2) so as to maintain the shape and size of the pile holes (2) in the ground (1). Each of the pile holes (2) is formed with an enlarged lower end portion (21) in a known manner.

The second step is to provide each of the pile holes (2) with a poured-concrete pile (23) which is divided into two substeps. The first substep is to place several annularly arranged vertical steel rods (22) in each of the pile holes (2). Next, a cement material is poured into the pile holes (2) to constitute poured-concrete piles (23). The rods (22) including the portions that extend above the concrete, as shown in FIG. 1, become a component of the piles.

Figure 3:
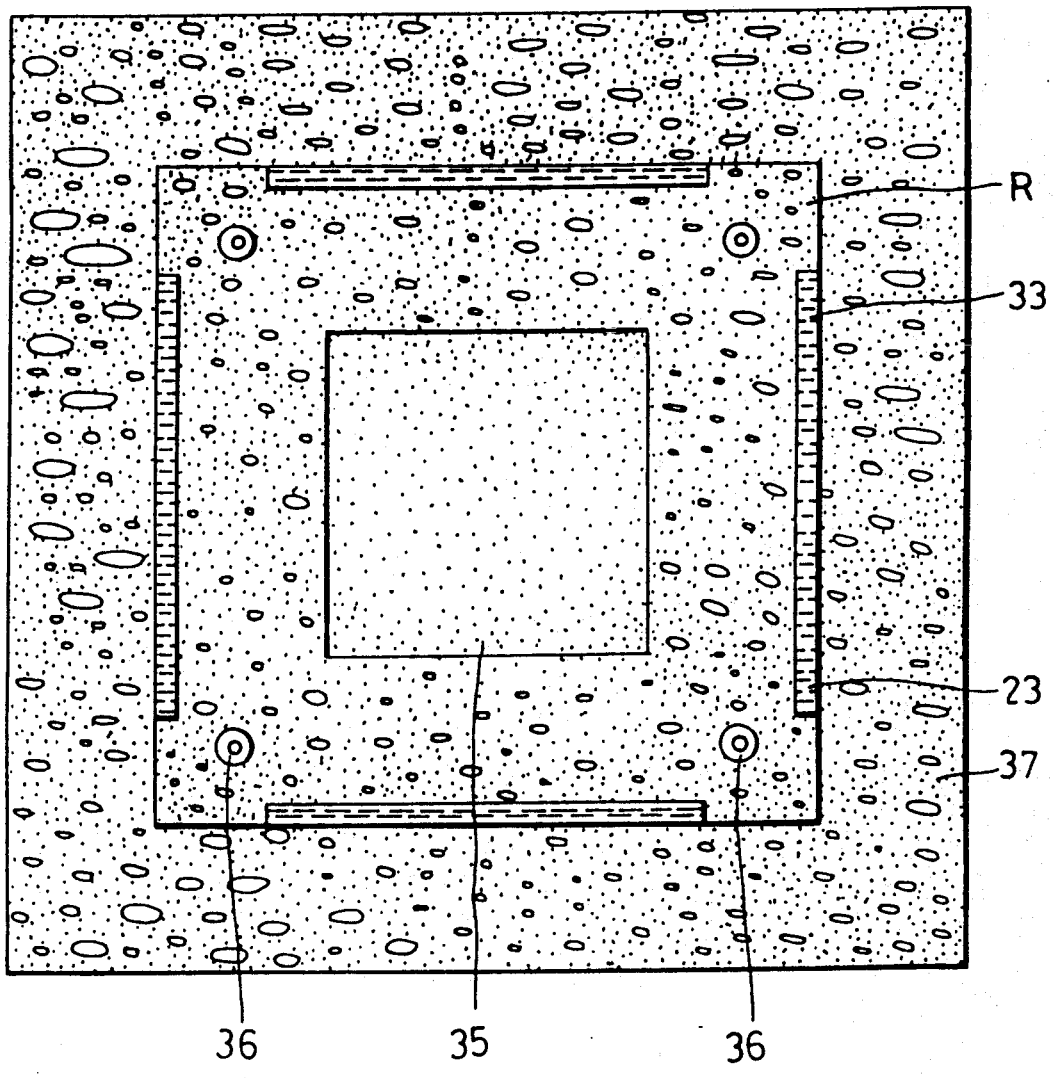
FIG. 3 is a top view illustrating the method of this invention.

The third step is to provide several vertical guide holes (36) and an excavation passage (35) which are formed through the basement structure (3), wherein the guide holes (36) are aligned with the pile holes (2). The excavation passage (35) and each of the guide holes (36) have three sections which are formed in the basement floors (34). The basement structure (3) further has an outward flange (32) (see FIG. 1) projecting outward from the bottom end thereof, four corner ribs (R) (see FIG. 3) projecting outward from the peripheral walls of the basement structure (3), and an inclined inner surface (39) disposed at the bottom end of the basement structure (3) so as to prevent the piles (23) from hindering the downward movement of the basement structure (3). The outward flange (32) and the corner ribs (R) together define four agent accommodating spaces (33) in the basement structure (3). An annular guide body (37) is provided on the ground and surrounds the basement structure (3).

Figure 5:
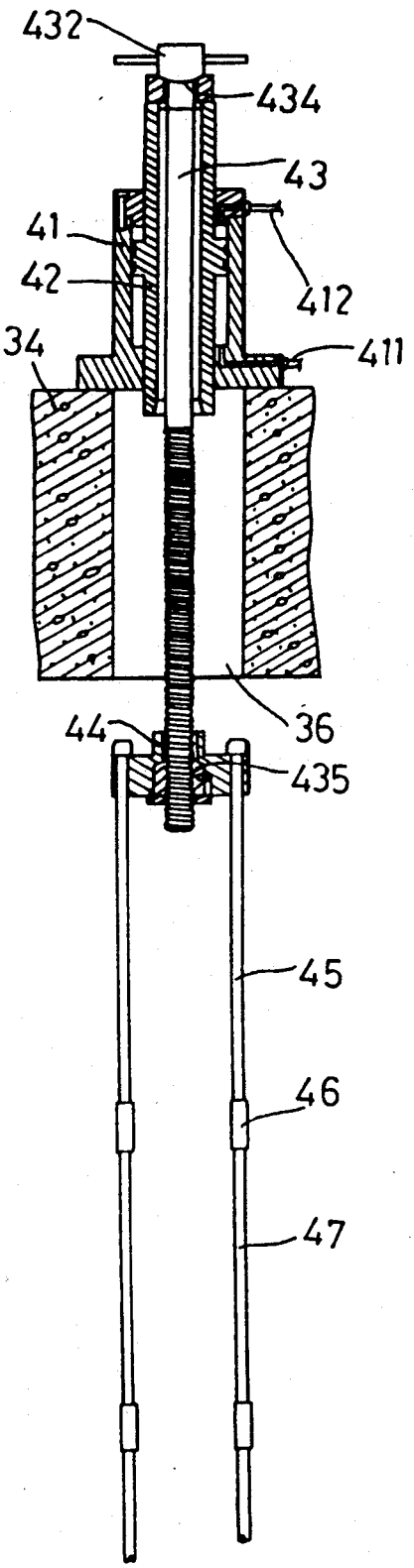
FIG. 5 is a schematic view illustrating how the impelling device moves the basement structure.
Figure 4:
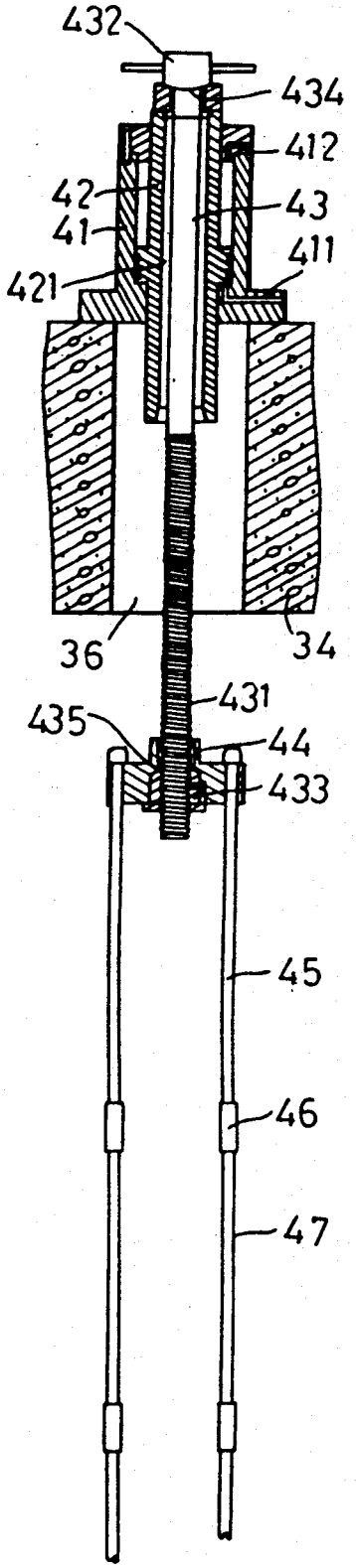
FIG. 4 shows an impelling device used in the method of this invention.
Figure 6:
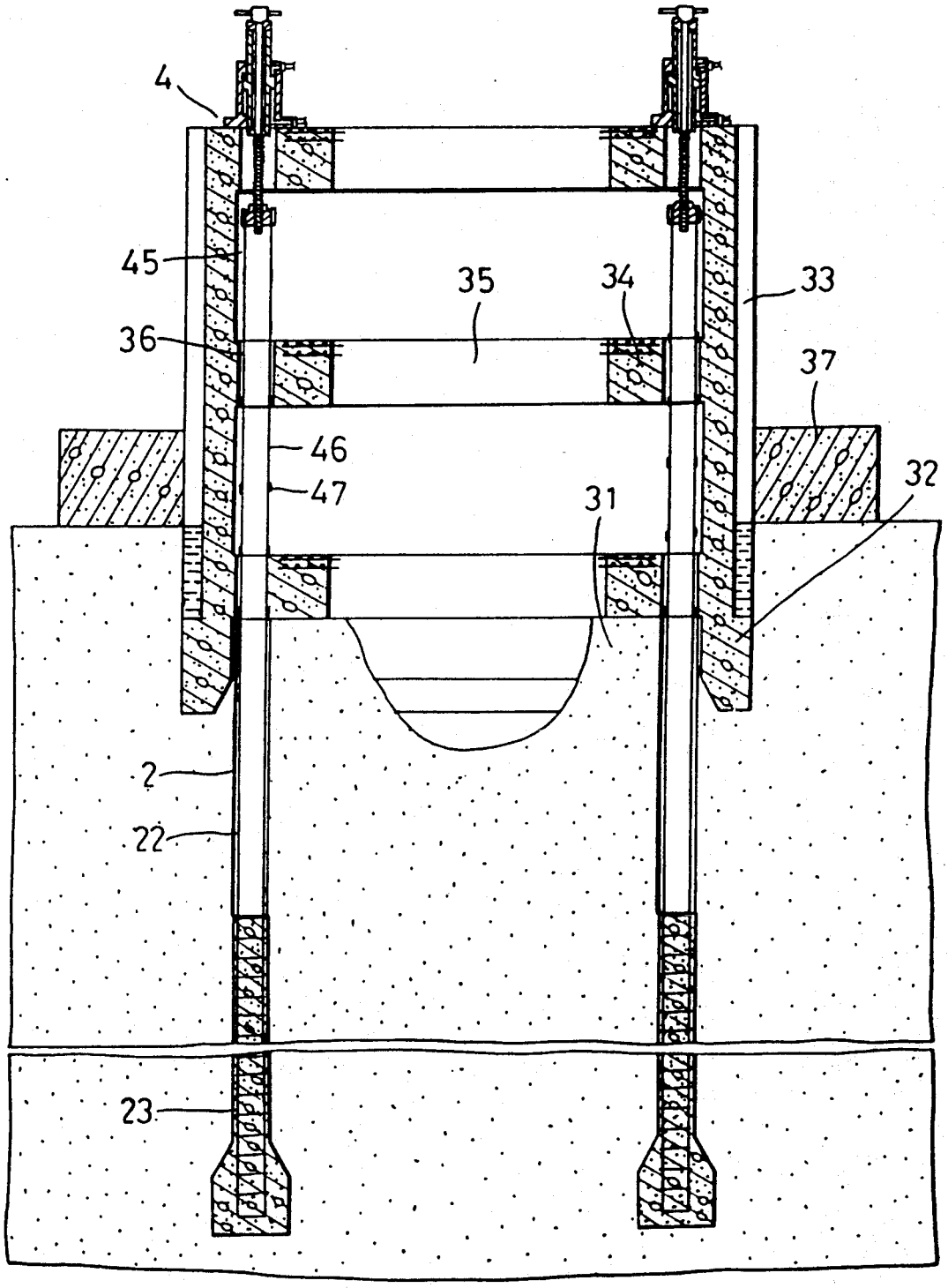
FIG. 6 illustrates the position of the basement structure which has been partially lowered into the ground.

The fourth step is to equip each of the guide holes (36) with an impelling device (4) which is coupled with one of the piles (23). Referring to FIGS. 4, 5 and 6, each of the impelling devices (4) includes an upright hydraulic cylinder body (41), a piston rod (42), a piston (P) (see FIG. 7), an internally threaded engaging member (44), and several coupling bar units (45). The cylinder body (41) is fixed on the top surface of the basement structure (3). The piston rod (42) extends through the piston body (41) and has a central bore (421) through which a central rod (43) extends. The central rod (43) has an externally threaded lower portion (431) which is engaged within the engaging member (44). A horizontal rotary lever unit (432) is secured to the upper end of the central rod (43) so that the rotation of the rotary lever unit (432) moves the piston rod (42) and the central rod (43) vertically relative to the engaging member (44). The piston (P) is sleeved rigidly on the piston rod (42) and is received slidably in the cylinder body (41). A nut member (433) is engaged threadably with the lower end portion of the central rod (43) and is positioned within the enlarged lower end portion of the threaded central bore of the engaging member (44). The piston rod (42) and the rotary lever unit (432) have curved interengaging surfaces (434) so as to obtain firm connection therebetween. Likewise, the upper end portion of the nut member (433) and the engaging member (44) have curved interengaging surfaces (435) so as to obtain firm connection therebetween.

Each of the several bar units (45) includes several vertical bar sections (47) arranged in a line. Each adjacent pair of the bar sections (47) are detachably interconnected by a collar (46). The uppermost bar sections (47) are connected securely to the engaging member (44). The lowermost bar sections (47) are connected securely to the upper ends of the steel rods (22).

The fifth step is mechanical excavation of soil below the basement structure (3) through the excavation passage (35) of the basement structure (3).

Figure 7:
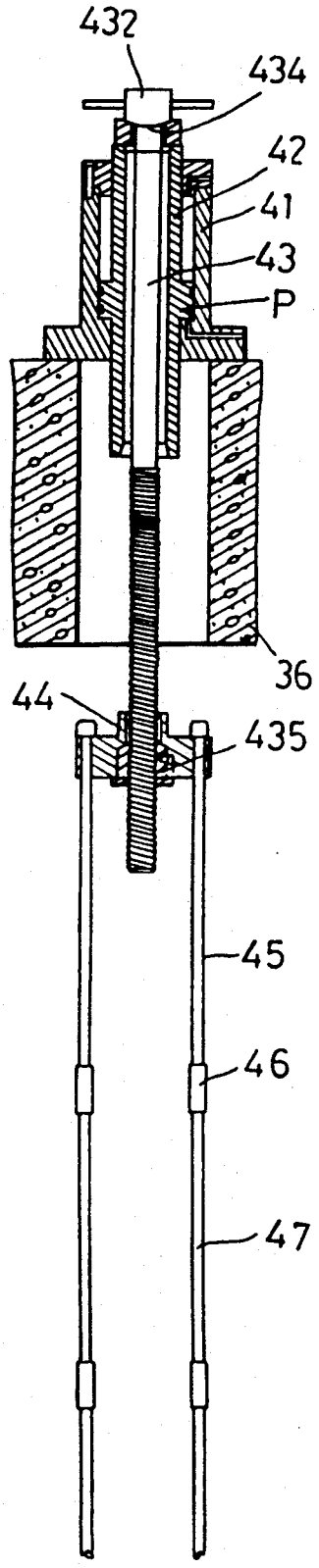
FIG. 7 is a schematic view illustrating how to lower a piston rod in the method of this invention.
Figure 8:
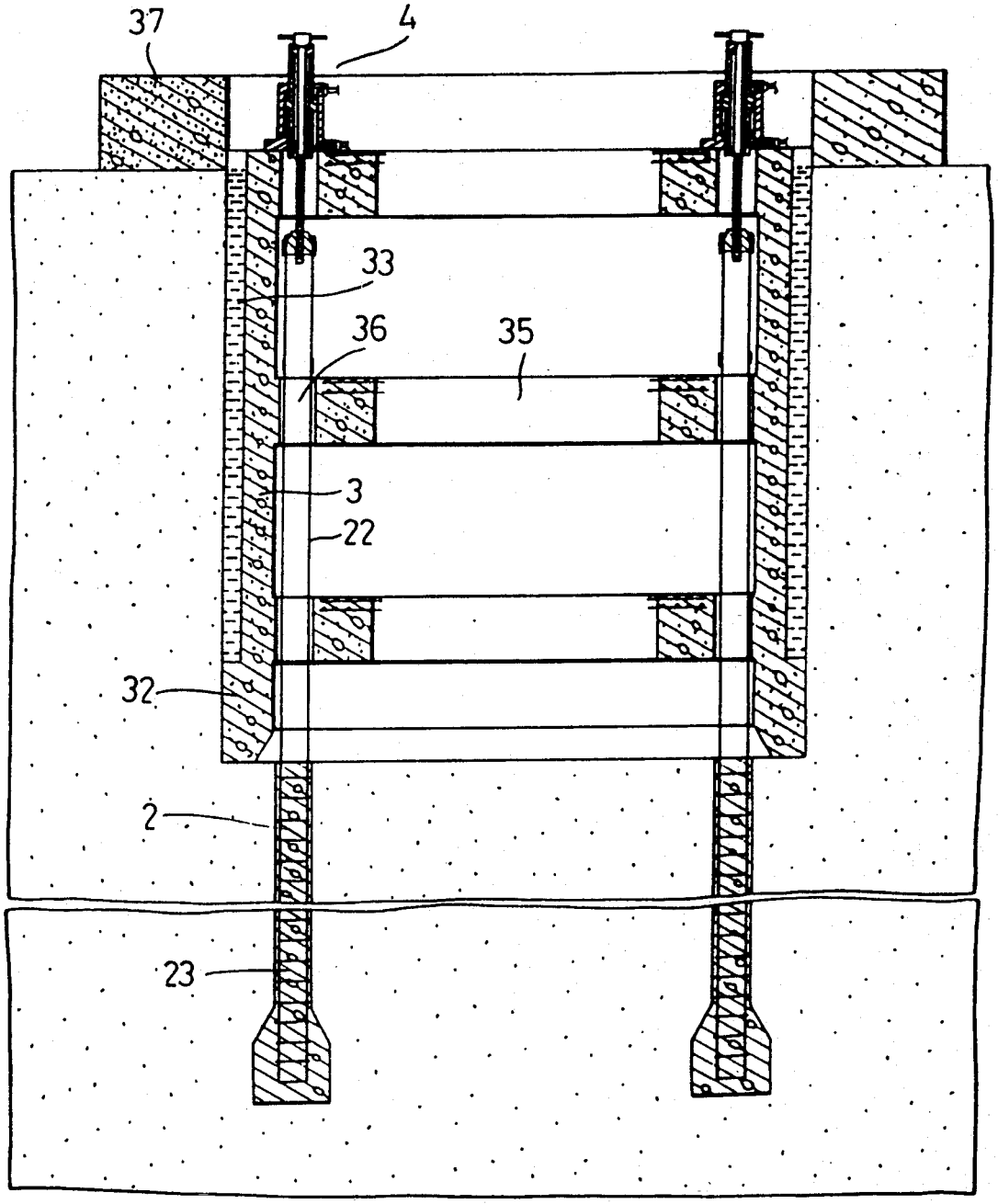
FIG. 8 illustrates the position of the basement structure which has been lowered into a predetermined position in the ground.

The sixth step is to activate the impelling devices (4) to help lower the basement structure (3) into the ground by gravity in such a manner that the piles (23) extend through the guide holes (36) of the basement structure (3). Referring to FIG. 5, when a hydraulic liquid is introduced into the cylinder bodies (41) below the pistons (P), the pistons (P) and the piston rods (42) are moved upward in the cylinder bodies (41) so that the rotary lever units (432) impel the cylinder bodies (41) and the basement structure (3) to move downward. When the pistons (P) reach their uppermost positions in the piston bodies (41), the hydraulic liquid in the cylinder bodies (41) is removed from below the pistons (P) so as to move the pistons (P) to their lowermost positions in the piston bodies (41). Afterwards, as shown in FIG. 7, the rotary lever units (432) are actuated to move the piston rods (42) and the central rods (43) downward. During the downward movement of the piston rods (42) and the central rods (43), it is necessary to intermittently remove the uppermost bar sections (47) from the rest of the coupling bar units (45) so as to prevent the basement structure (3) from engagement with the upper ends of the coupling bar units (45). In this way, the basement structure (3) can be lowered to the predetermined position shown in FIG. 8. It is understood that the engagement of the piles (23) with the guide holes (36) maintains the levelness of the basement structure (3) during lowering of the same. A soil stabilizing agent is applied to the agent accommodating spaces (33) between the basement structure (3) and the ground during the lowering of the basement structure (3).

Figure 9:
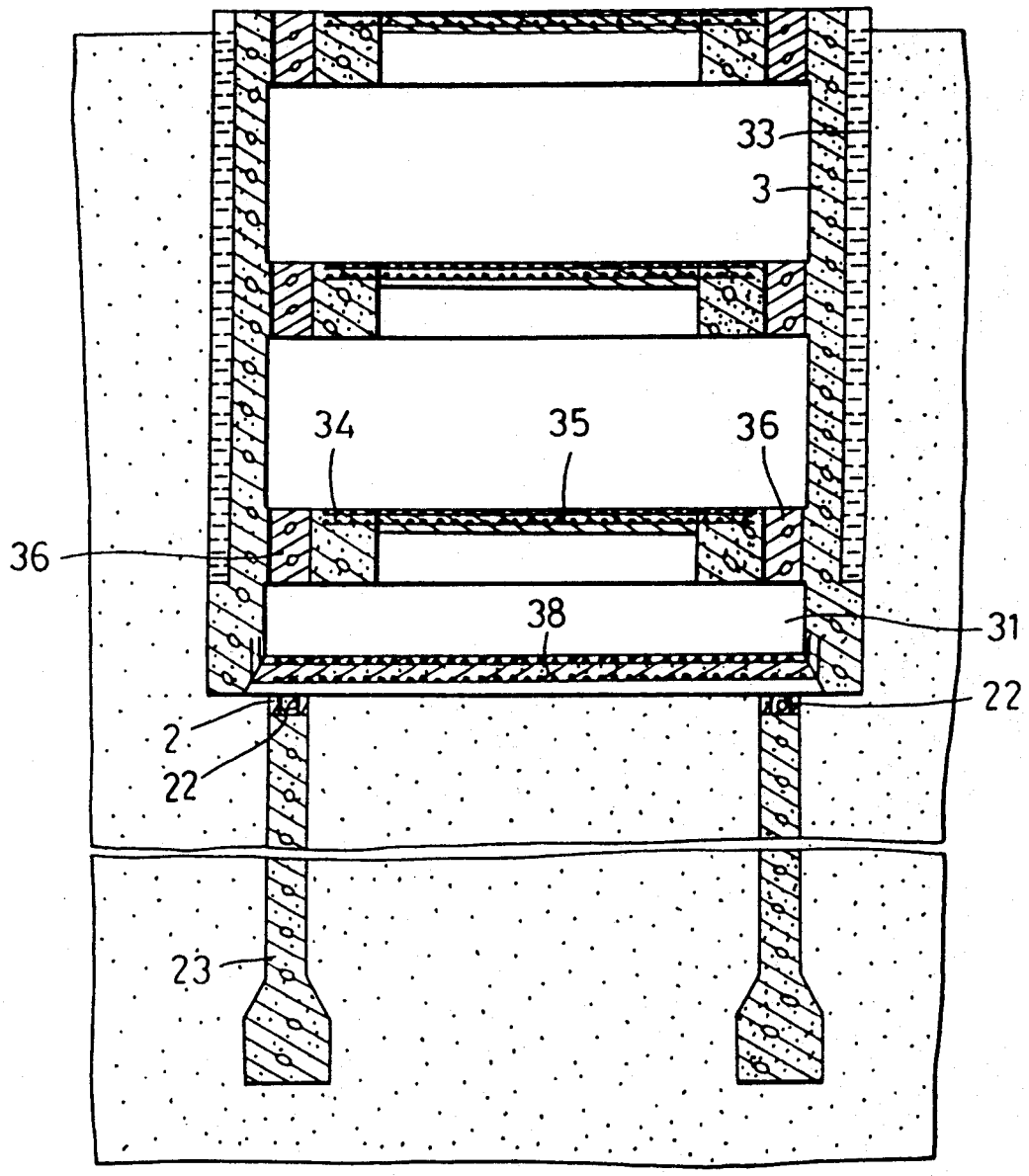
FIG. 9 illustrates the completion of the basement.

Referring to FIG. 9, the seventh step is to replace the soil stabilizing agent in the agent accommodating spaces (33) with a cement material. The eighth step is to cut the upper portions of the steel rods (22) and the piles (23), which extend into the basement structure. The ninth step is to provide the basement structure (3) with a ground floor (38) which defines a reservoir accommodating space (31) in the bottom end portion of the basement structure (3). The tenth step is to pour a cement material into the sections of the guide holes (36). The eleventh step is to provide three concrete layers to close the upper ends of the sections of the excavation passage (35). Finally, the annular guide body (37) is removed from the basement structure (3).

Because the piston rod (42) is carried on the central rod (43), the externally threaded lower portion (431) of the central rod (43) may be regarded as an extension of the piston rod (42).

With this invention thus explained, it is apparent that numerous modifications and variations can be made without departing from the scope of this invention. It is therefore intended that this invention be limited only as indicated in the appended claims.

I claim:

1. A method for lowering a basement structure into a ground, the basement structure being constructed on the ground in advance, the method comprising the following steps:

(1) drilling into the ground to form several upright pile holes in a region in which the basement structure is to be installed;

(2) providing each of said pile holes with a poured-concrete pile;

(3) providing several vertical guide holes and an excavation passage which are formed through the basement structure, said guide holes being respectively aligned with said pile holes;

(4) equipping each of said guide holes with an impelling device which is coupled with one of said piles;

(5) excavating soil below the basement structure; and (6) activating said impelling devices to lower the basement structure into the ground in such a manner that said piles extend through said guide holes of the basement structure.

2. A method as claimed in claim 1, further comprising the steps of:

(1) when constructing the basement structure, providing the basement structure with an outward flange projecting outward from a bottom end thereof and with four vertical corner ribs projecting outward from corners of the basement structure to form an agent accommodating space in each of outer walls of the basement structure; and (2) applying a soil stabilizing agent into said agent accommodating spaces between the basement structure and the ground during lowering of the basement structure.

3. A method as claimed in claim 1, wherein step (2) includes providing several vertical steel rods embedded in each of said piles, and wherein step (4) includes equipping each of said impelling devices with:

an upright cylinder body fixed on a top end of the basement structure;

a piston rod extending through said cylinder body and having an externally threaded lower portion;

a piston sleeved rigidly on said piston rod and received slidably in said cylinder body;

an internally threaded engaging member engaged with said externally threaded lower portion of said piston rod;

several coupling bar units interconnecting securely said engaging member and upper ends of said steel rods, each of said coupling bar units including several vertical bar sections arranged in a line and several collars respectively and detachably interconnecting an adjacent pair of said bar sections, the uppermost one of said bar sections being connected securely to said engaging member, the lowermost one said bar sections being connected securely to an upper end of said steel rods; and a horizontal rotary lever unit secured to an upper end portion of said piston rod, rotation of said rotary lever unit moving said piston rod vertically relative to said engaging member;

said method further including introducing a hydraulic liquid into said cylinder body below said piston to cause said piston and said piston rod to be moved upward in said cylinder body so that said rotary lever unit impels said cylinder body and the basement structure to move downward.

4. The method of claim 1, including coupling each of said impelling devices with one of said piles by interconnecting several coupling bar units to the upper ends of steel rods embedded in said piles, said coupling bar units including several vertical bar sections arranged in a line and detachably interconnected; and removing said bar sections one by one from the uppermost one in said line to accommodate the lowering of said basement structure.

5. The method of claim 1, wherein said activating step includes applying tension on structure coupling each of said impelling devices to a respective one of said piles to apply a downward force on said basement structure.

6. An impelling device for lowering a structure, comprising:

an upright cylinder body fixed on a top end of the structure;

a piston rod extending through said cylinder body and having an externally threaded lower portion;

a piston sleeved rigidly on said piston rod and received slidably in said cylinder body;

an internally threaded engaging member engaged with said externally threaded lower portion of said piston rod and adapted to be fixed on an upper end of an article; and a horizontal rotary lever unit secured to an upper end portion of said piston rod, rotation of said rotary lever unit moving said piston rod vertically relative to said engaging member;

said structure and said article being connected to said cylinder body and said piston rod in a manner such that when a hydraulic liquid is introduced into said cylinder body below said piston, said piston and said piston rod are urged to move upward in said cylinder body so that said rotary lever unit impels said cylinder body and the structure to move downward.

7. An impelling device as claimed in claim 6, wherein several coupling bar units interconnect securely said engaging member and the upper end of the article, each of said coupling bar units including several bar sections arranged in a line and several collars respectively and detachably interconnecting an adjacent pair of said bar sections, the uppermost one of said bar sections being connected securely to said engaging member, the lowermost one of said bar sections being fixed on the article.

8. An impelling device as claimed in claim 6, wherein said cylinder body and said rotary lever have curved interengaging surfaces so as to obtain firm connection therebetween.

9. An impelling device as claimed in claim 6, wherein said piston rod includes a nut member engaged with a lower end portion thereof, said engaging member having a threaded central bore with an enlarged lower end portion in which said nut member is positioned, said engaging member and an upper end portion of said nut member having curved interengaging surfaces so as to obtain firm connection therebetween.

10. A combination comprising:

a plurality of spaced piles vertically oriented in pile holes in a region in which a basement structure is to be installed;

a basement structure positioned on the ground above said piles, said structure including one or more spaced floors each of said floors having a plurality of guide holes respectively aligned above one of said piles, said basement structure also including a passage through said floors by which soil below the basement structure maybe excavated; and an impelling device mounted on said basement structure aligned with each of said piles, said impelling devices being connected to said piles by way of said guide holes and connected to said basement structure in a manner such that a downward force applied to said basement structure by said impelling devices produces a reactionary tension force applied to said piles whereby said basement structure may be guided downwardly by said piles as the soil beneath the basement structure is excavated.

11. The combination of claim 10, wherein said impelling device includes several coupling bar units interconnecting said devices to said piles, said units being releasably interconnected so that the uppermost ones of said units may be selectively removed as said basement structure is lowered.

12. The combination of claim 10, wherein said piles include the plurality of steel rods embedded in concrete and extending above said concrete and being connected to said impelling devices.

13. The combination of claim 10, wherein said basement structure includes a lower end engaging the ground, a flange projecting outwardly from said lower end, four corner ribs extending upwarldy from the lower end, four corner ribs together defining four spaces on the exterior of the basement structure for receiving soil stabilizing agent.

14. The combination of claim 10, wherein said basement structure includes a lower end resting on the ground and including an annular guide body on the ground surrounding the basement structure to help guide said structure into the ground.

* * * * *